United States Patent [19]

Walsh

[11] 4,201,349

[45] May 6, 1980

[54] FOOD RETAILING GRINDING MACHINE

[75] Inventor: David E. Walsh, Fargo, N. Dak.

[73] Assignee: General Nutrition Corporation, Pittsburgh, Pa.

[21] Appl. No.: 959,868

[22] Filed: Nov. 13, 1978

[51] Int. Cl.[2] ..... B02C 7/04

[52] U.S. Cl. ..... 241/247; 241/259.1; 241/261; 241/261.2

[58] Field of Search ..... 241/245–248, 241/259.1, 259.2, 259.3, 261, 261.2, 261.3, 36

[56] References Cited

U.S. PATENT DOCUMENTS

| | | | |
|---|---|---|---|
| 2,937,815 | 5/1960 | Eirich et al. | 241/245 X |
| 3,010,662 | 11/1961 | Johnson | 241/36 |
| 4,027,824 | 6/1977 | Fuller | 241/247 X |
| 4,085,899 | 4/1978 | Boothe | 241/261.3 X |

*Primary Examiner*—Mark Rosenbaum

*Attorney, Agent, or Firm*—Parmelee, Miller, Welsh & Kratz

[57] ABSTRACT

A motor-driven grinding machine or unit has been provided to enable consumer-selected food items, such as nut kernels and grains to be quickly, uniformly and efficiently ground to a desired consistency in his or her presence. The machine has a chute with a motor-controlling lid that is adapted to receive selected food items and to feed them to a rotating auger shaft which extends into a processing housing. Food items are then advanced substantially radially outwardly between a pair of heads having opposed disc-like grinding surfaces, each of which has a set of inner, widely spaced-apart, relatively coarse teeth and an outer, relatively finer, closely spaced-apart set of teeth between which the food is advanced while the auger shaft rotates one of the heads and the food items are being ground and advanced between the surfaces strategically designed and positioned in a positive manner to reduce them to a desired uniform particle size. Slot portions between the teeth of the inner and outer sets provide outward flow paths for the food being ground that avoid clogging and excessive heat build-up, while assuring a full and uniform grinding and an outwardly advancing flow of the food between the pair of heads. The food as thus ground into a butter, meal or flour is moved peripherally forwardly into a front portion of the processing chamber, with a wiping action being effected by the rotating head for delivering the processed food through a down-spout or open portion in the housing. External means is provided for adjusting the axial position of the rotating head to control the operating relation between the teeth of the cooperating opposed grinding surfaces.

15 Claims, 16 Drawing Figures

Out Flow
C
M
G
E
S1
S2

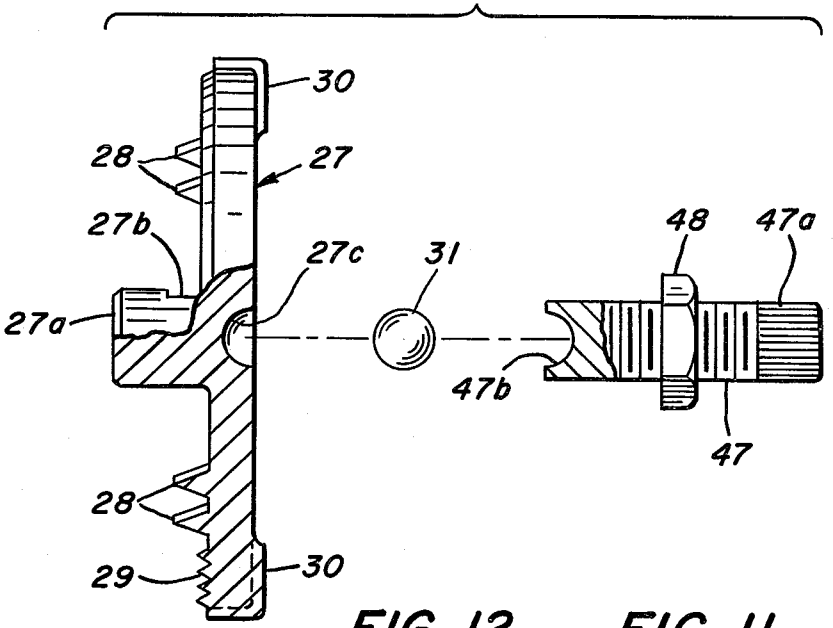
FIG. 10
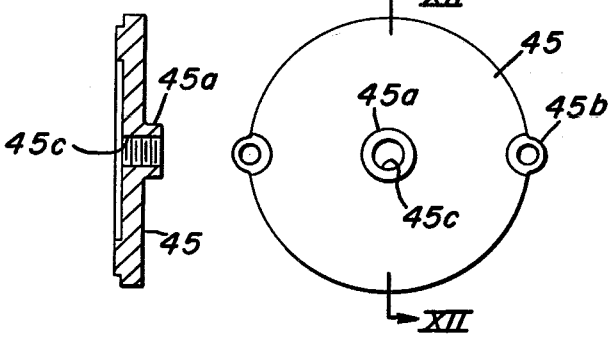
FIG. 11
FIG. 12
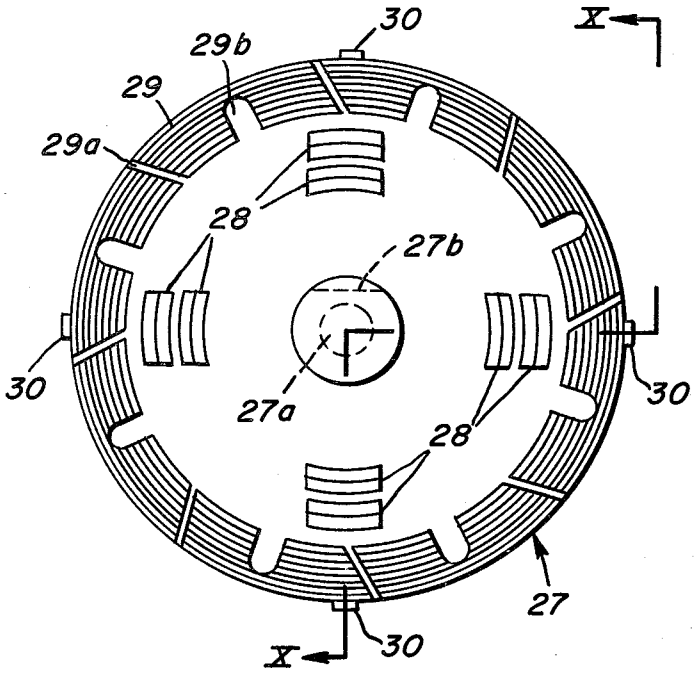
FIG. 9

FOOD RETAILING GRINDING MACHINE

BRIEF SUMMARY OF THE INVENTION

This invention relates to an improved apparatus for the fresh grinding of food, nut or grain kernels for on-the-spot dispensation or sale. It relates particularly to a motorized machine that may be efficiently utilized in a retail store for grinding food items to provide nut butter, grain meal or flour in accordance with customer requirements.

BRIEF DESCRIPTION OF THE DRAWINGS

FIG. 9 is a back end view on the scale of FIG. 6 showing a rotating cutter disc or grinding head of the apparatus of FIGS. 1 and 2;

FIG. 10 is an exploded view in partial section on line X—X and on the scale and of the head shown in FIG. 9; this view additionally shows the relation between the head, a ball bearing and an adjusting screw or bolt;

FIG. 11 is a reduced end view in elevation of a front end cap or housing part for the grinding assembly of FIGS. 1 and 2; and FIG. 12 is a horizontal cross section on the scale of and taken along the line XII—XII of FIG. 11.

BACKGROUND OF THE INVENTION

Figures 1, 2, 2A, 3, 3A, 4:
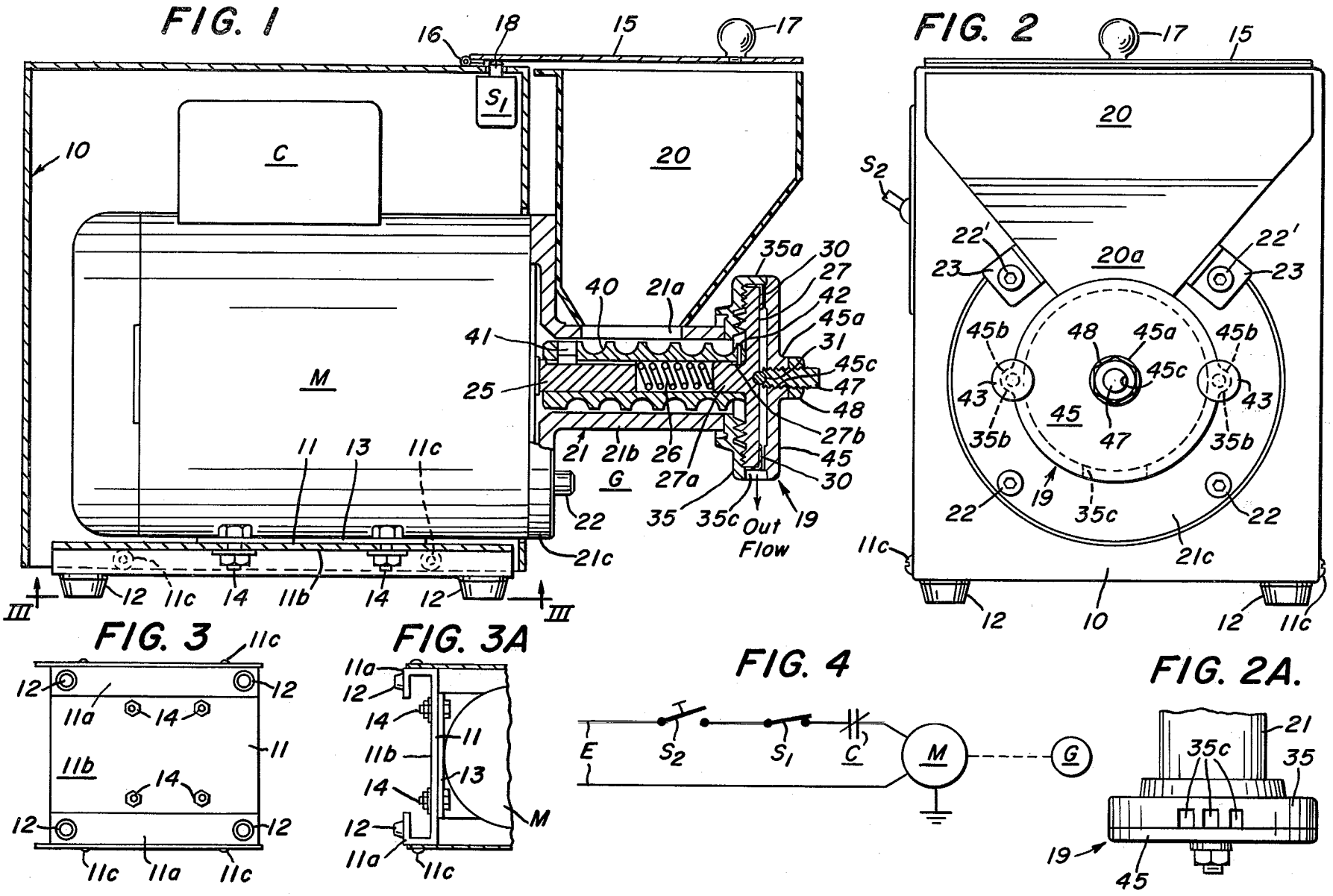
FIG. 1 is a side view in elevation and partial section showing an apparatus or machine of the invention.
FIG. 2 is a front end view in elevation on the scale of and showing the apparatus of FIG. 1.
FIG. 2A is a fragmental view on the scale of FIG. 1, taken from the bottom of the front end assembly of the apparatus and showing down-spout outlets.
FIG. 3 is a reduced bottom plan view taken along the line III—III of FIG. 1, showing the bottom mounting of a motor housing of the machine of FIG. 1.
FIG. 3A is a fragmental end view of the structure of FIG. 3.
FIG. 4 is a representative electrical schematic showing a circuit for actuating the motor of the apparatus of FIGS. 1 and 2.

There has been a need for an improved apparatus for grinding and dispensing food items, such as nuts in the form of a butterlike spread or grains in the form of a meal or flour of a desired uniform texture which may be quickly and effectively accomplished on customer demand at a retail store. Heretofore, difficulty has been encountered in providing an apparatus with which food items may be effectively and quickly processed to provide a fully and uniformly ground, finely textured product of a suitable viscosity, and without small, incomplete and irregular particles or granules being present. The machine should be capable of safe operation in the presence of a customer, should effectively maintain sanitary standards, and quickly without overheating or the need for interruption, effectively form a desired product for immediate sale as a "fresh" product. A machine of this type has to be easily adjusted as to the fineness of its grind to suit the particular customer's desires. It should also operate in a simple, but positive and efficient manner to attain a desired consistency and fineness of ground food product, and enable the utilization of a motor driven, space-conserving operating mechanism.

GENERAL DESCRIPTION OF THE APPARATUS

The grinding machine of the present invention is thus of a type that is designed and is particularly suitable for retail store usage, such as to provide ground meal, flour or nut butter from grains or from nut kernels to satisfy requirements of each customer. The machine is of a type that permits "on the spot" cutting-up or grinding and dispensing of food items for immediate sale to a customer. The grinding action is adjustable to provide a smooth butter type of product from, for example, nut kernels, or to provide a fine powder, for example, from grain kernels. Further, the machine is easily cleanable and has a fully sanitary design such that the food items are completely enclosed from the time they are introduced into a feed hopper or chute 20 until they are delivered through down-spouts or open outlet portions 35*c* from a front end portion of its housing. An empty container or a plastic bag may be placed under the spout to receive the processed food as it is delivered.

Safety features are incorporated such that there is no danger of injury to the fingers of an operator or of jamming the apparatus with a spoon or scoop when a hinged lid 15 for the feed chute 20 is open and food items are being introduced therein. The construction is such that the food items are continuously and positively advanced through the machine and ground to any desired texture or fineness, irrespective of the size or shape of nuts, such as peanuts, cashews, almonds, walnuts, etc. that are used to make nut butter or the size or shape of grains, such as wheat, barley, oats, soy beans, rye, buckwheat, etc. that are to be used to make meal or flour.

Food items are not only positively advanced, but are effectively ground to a uniform desired texture and size during their somewhat radial-outward advancing movement between opposed disc-like grinding blade surfaces of a pair of relatively rotating grinding heads 27 and 35. The blade surfaces have sets of teeth along their opposed, relatively rotating faces, and also have material-advancing, flow spaces or groove portions that provide for and facilitate advancement of the food items, without omitting the grinding of any kernels or grains, without jamming the apparatus, and in a continuous manner without an excessive build-up of heat in the grinding heads.

A progressive, uniform cutting and grinding action is positively accomplished by the use of a motor-driven rotating auger or worm 40 which advances the food items from a reduced width bottom end of the feed chute 20 and preliminarily grinds them as they are advanced between the auger and a cylindrical hub 21*b* of a back housing part 21. The food items are then progressively advanced in a generally somewhat radial outward direction within a back portion of a processing chamber defined by the head 35 and a front housing part 19, and are therein first ground between the pair of grinding heads 27 and 35 by cooperating substantially complementary, inner, relatively coarse primary sets of teeth on the heads that have a widely spaced, quadrant relationship (see FIGS. 7 and 9). The food items are subsequently ground therein by cooperating, substantially complementary, outer, peripherally located, relatively fine, secondary sets of teeth on the heads. The secondary set of teeth 29 of a rotating grinding head 27 (see FIG. 9) of the pair has an inner group of secondary teeth that are crossed or bisected by a plurality of relatively wide feed groove portions **29*b* that extend a short distance radially outwardly, but that are closed-off or terminate adjacent an outer group of the secondary teeth. However, intermediate, more narrow groove portions 29*a* that incline or slope off-radially in the direction of rotation (clockwise) of the rotating head 27 are located in substantially intermediate spaced-apart positions between the first-mentioned relatively wide groove portions 29*b*, and extend completely across all of the teeth representing both the inner and outer groups of the secondary set 29. A stationary head 35 (see FIG. 6) of the pair has off-radially extending, somewhat wide, through extending groove portions 37*a* in an equally spaced relation about its secondary set of finer teeth 37. Like the groove portions 29*a*, the groove portions 37*a* incline or slope off-radially in the direction of rotation of the rotating head 27**.

DETAILED DESCRIPTION

A grinding unit G of the invention is secured in position on an end of a housing 10 of an electric motor M and over its drive shaft 25. The unit G has a feed chute or hopper 20 whose hinge-mounted lid 15, when lifted or opened by hand grip knob 17, will cause a motor-energizing limit switch $S_1$ to open an electrical, motor-energizing circuit (see FIGS. 1 and 4) while food items, such as shelled peanuts, are being introduced. The lid 15 when closed will then automatically close the switch $S_1$ to energize the motor M. A separate "on" and "off" manual switch $S_2$ and a capacitor C for the motor M are shown in the circuit of FIG. 4 which is energized by a conventional source of electrical energy E.

Figure 5:
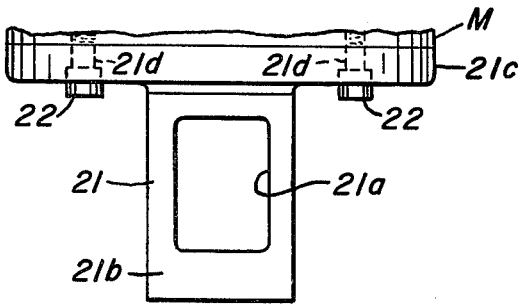
FIG. 5 is a reduced fragmental plan view with feed hopper or chute removed, particularly illustrating the mounting of an intermediate cylindrical housing for an auger shaft shown in FIG. 1.

A collar-like, spiral feed auger, screw, worm part or shaft 40 is secured by a rectangular, end-positioned, cross or latch pin 41 for driven rotation with the drive shaft 25 of the motor M beneath a lower, converging, open portion **20*a* (see FIG. 2) of the feed chute 20. The pin 41 is shown mounted in an elongated or axially extending slot along the motor shaft 25 (see FIG. 1) for assuring a positive drive of the auger collar 40, while permitting relative axial movement between the auger 40 and the shaft 25. The auger or worm 40 (see FIGS. 1 and 2) progressively picks-up and positively advances food kernels or grain delivered by gravity from funnel-like, converging, bottom, open end portion 20*a* of the chute 20, through a slot-like open mouth or window portion 21*a* (see also FIG. 5) in a connecting neck, collar or cylindrical hub portion 21*b* of a shaft-receiving, back housing part 21 to feed and advance them axially forwardly into substantially circular, radially offset, food processing or grinding chamber that is defined by the housing 19 provided by back grinding head 35 and front end housing part of cap 45. The food items are preliminarily ground with the enclosing hub portion 21*b* of the housing 21 and are positively advanced by the auger screw 40 into a back entry and main grinding chamber portion of the food processing chamber. Thereafter, they are positively substantially radially-outwardly advanced between opposed grinding blade surfaces of the pair of cutting blades, discs or ginding heads 27 and 35 in the front chamber portion, and peripherally between the outer edge or rim of rotating head 27 and an outwardly spaced, forwardly extending rim flange 35*a* of stationary head 35**.

It will be noted that the back entry and main grinding portion of the food processing chamber is provided between the grinding surface of the fixed or stationary head 35 inside the back wall of the housing assembly and the cooperating, somewhat complementary, rotatable grinding head 27. The front chamber portion is defined between the front face of the rotating head 27 and the front end housing cap 45 of the assembly 19.

As previously indicated, the groove portions **29*a* of the blade 27 extend in an off-radial direction similar to the groove portions 37*a* of the blade 35, and both are inclined in the direction of rotation of the disc 27 to further the upward advance of the food particles as they are being ground and positively moved, as ground, towards the spacing between the rim flange 35*a* and the outer peripheral edge of the rotating head 27. Both the inner and outer groups or sets of teeth thus have feed grooves or space portions for permitting a somewhat free type of axial "in," radial "up," and peripherally forward "over" flow of the food items being ground in the back chamber portion between opposed faces of the pair of disc-like grinding blade surfaces of the heads 27 and 35, without any tendency to overheat or jam the device. The ground food material, after passing forwardly across the outer peripheral edge of the rotating blade member 27, is wiped and advanced by peripherally spaced-apart blades 30 (see FIGS. 1 and 9) of angular shape. The wiper blades 30 are equally spaced, quadrant-positioned and extend from the outer peripheral edge of the rotating blade 27**, slightly downwardly along its front or outer face. They may be of solid metal or other suitable material.

Figure 6:
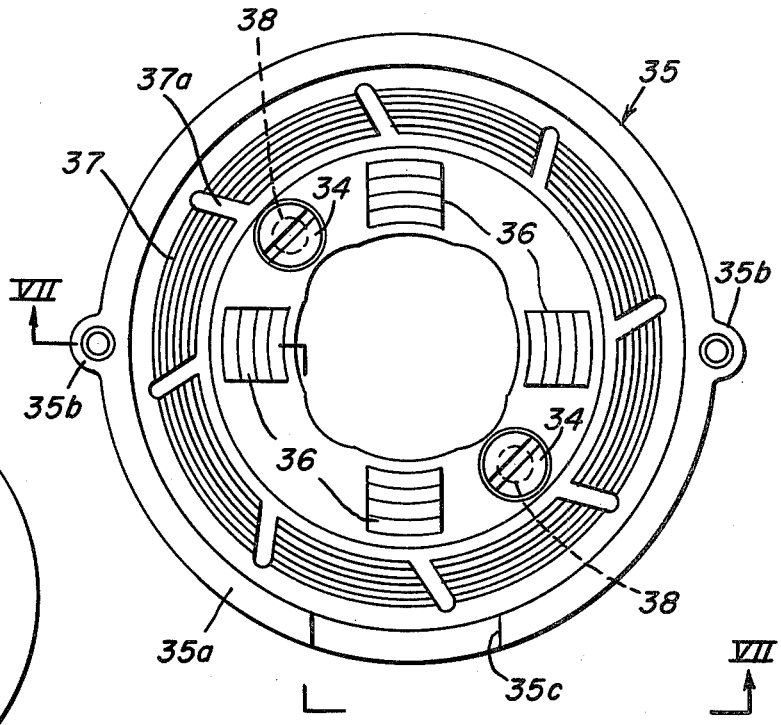
FIG. 6 is a front end view on an enlarged scale of a stationary fixed cutter disc or grinding head shown in FIG. 1, and particularly illustrating the construction and mounting of its inner and outer sets of teeth.
Figure 5A:
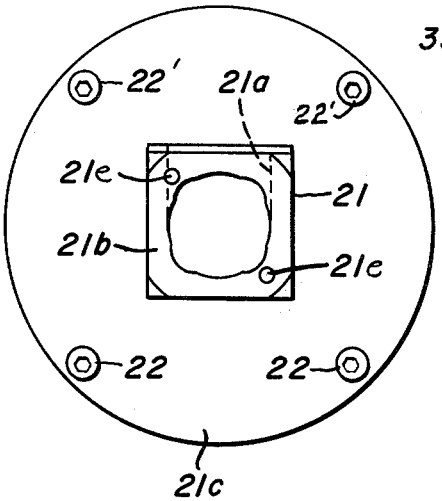
FIG. 5A is a front end view in elevation on the scale as and of the structure of FIG. 5.
Figure 7:
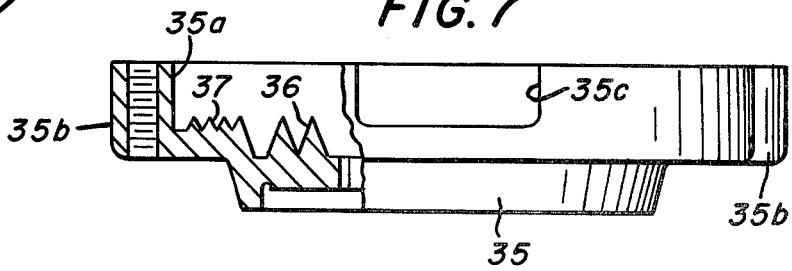
FIG. 7 is a partial horizontal section taken along the line VII—VII, on the scale and of the grinding head of FIG. 6.

As shown in FIGS. 6 and 7, the stationary head 35 has a pair of countersunk holes 38 through its face wall in the spacing between the relatively coarse teeth 36 to receive flat head screws 34 that are mounted in aligned, threaded bores **21*e* (see FIG. 5A) extending into the front end wall of the collar or hub portion 21*b* of shaft-enclosing housing 21. The head 35 also has a pair of mounting tabs or ears 35*b* that project from its rim flange 35*a* to align with tabs or ears 45*b* that project from the front housing cap 45 (see also FIGS. 2 and 11). The tabs 35*b* are drilled and threaded as shown in FIG. 7 to receive thumb-head mounting screws or bolts 43 (see FIG. 2) that extend through a pair of aligned bores in the tabs 45*b* to secure the housing cap 45 in an assembled, complete, housing-defining relation with respect to and on the stationary head 35**.

As shown in FIG. 1, the rotatable blade 27 has a backwardly extending, solid hub or shaft end portion **27*a* which projects axially towards the motor drive shaft 25 in alignment therewith and in endwise engagement with a spring coil or helix 26. The spring coil 26 extends between a forward end of the motor drive shaft 25 and the end portion 27*a*. Rotation of the grinding or cutter head 27 is assured by a connecting cross pin 42 that extends transversely through a forward end of the feed worm or auger 40. The pin 42, at its inner end, extends into engagement with an elongated latching slot 27b that is elongated lengthwise of the hub portion 27a to permit axial or longitudinal adjustment of grind spacing between the rotating blade 27 and the stationary blade 35. The spring 26 is tensioned in its positioning and extends axially within the worm or auger 40 to thus urge the rotating blade 27 axially forwardly within the unit housing assembly 19**.

The front, central end portion of the rotating cutter blade 27 has a rounded, semi-circular slot portion 27c therein (see FIGS. 1, 9 and 10) that is adapted to receive a heavy duty, bearing-like ball 31 to extend forwardly therefrom. An adjustable bolt-like screw pin element, stud or shaft 47 is provided with a threaded stem portion which has a complementary fit within a threaded bore 45c (see FIGS. 1 and 12) that extends through a central hub portion 45a of the end cap 45 (see FIGS. 11 and 12). The innermost end 47b of the adjustable screw element 47 has a semi-circular seating shape to receive the ball 31 and through it, adjust the axial position of the rotating blade 27 against tension force exerted by the spring 26. The adjustable element 47 is provided with an outer, knurled hand grip portion 47a or wrench flat, to facilitate its turning adjustment. A nut 48 is shown mounted on the outer end portion of the screw element 47 for locking it in a suitable adjusted position.

With reference to FIGS. 1, 2, 5 and 5A, the enclosing housing 21 has an enlarged, circular back mounting flange 21c that has bores 21d to receive cap screws 22 that secure it to the front end of the housing 10 of the motor M by engagement within threaded bores in the motor housing. As shown in FIG. 2, the feed chute or hopper 20 is removably secured in position by a pair of angle-shaped mounting brackets 23 that extend from and are secured, as by welding, to opposite funnel or bin-like sides of the chute 20 to receive cap screws 22' that also extend through bore holes in the flange 21c into threaded bores within the motor housing 10.

With particular reference to FIGS. 1, 3 and 3A, the motor M is shown enclosed within a rectangular housing 10. A bottom mounting plate 13 which is secured, as by weld metal, to the bottom of the motor M is shown, in turn, secured by bolt, nut and lock washer assemblies 14 to a central portion 11b of a U-shaped, bottom closure wall plate member 11. The wall member 11 has channel-shaped portions 11a along its opposite sides on which rubber nubbles or feet 12 may be mounted. Metal screws 11c secure outer flanges of the side portions 11a to sides of the housing 10.

Limit switch $S_1$ (see FIG. 1) is shown mounted adjacent a piano hinge 16 that carries hopper lid 15. In this manner, push button 18 of the switch $S_1$ is pushed inwardly to close the electrical circuit (see also FIG. 4) when the lid or door 15 is closed. The button 18 is spring-pressed outwardly to disengage the electrical connection when the lid 15 (see knob 17) is swung up and back to introduce the food items, such as shelled kernels of nuts to be ground.

When the grinding is substantially completed, the food is advanced forwardly along the spacing between the outer periphery of the rotary cutter blade 27 and the inner periphery of the rim flange portion 35a of the fixed cutter 35. Thereafter, the food exits or leaves the front chamber portion of the housing 19 through downwardly open delivery spouts or outlets 35c in the rim flange 35a of the stationary grinding head 35. If desired, an outlet nipple or fitting (not shown) may be mounted, as by threading, to extend downwardly from the outlets 35c to facilitate directing the flow into a container or plastic bag. The bag or container, when filled, may then be closed-off by a tab or cap before delivery to the customer. As indicated in FIG. 2A, the out-flow of the ground food material is through a group of comb-like outlet openings 35c in the rim flange 35a. This out-flow of separate streams combines into a single stream downflow as delivered to a suitable container.

Figure 8A:
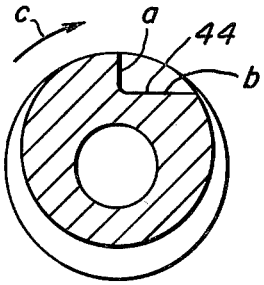
FIG. 8A is a section on the scale of and taken along the line A—A of FIG. 8.
Figure 8:
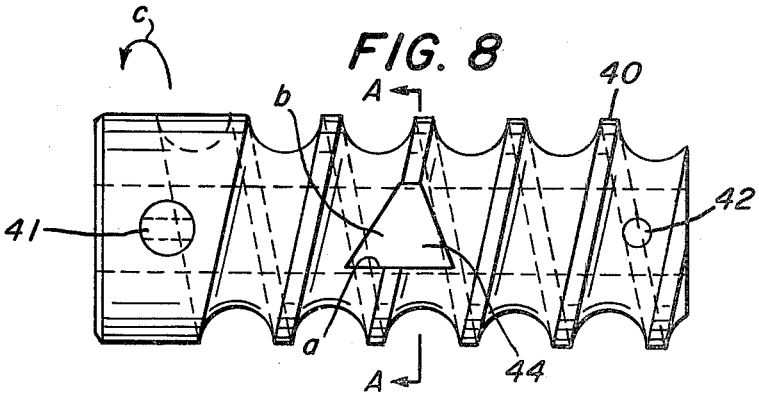
FIG. 8 is a plan view of a spiral feed screw, worm or auger shaft of the apparatus of FIGS. 1 and 2.

With reference to FIGS. 8 and 8A, the feed auger or worm 40 provides a food advancing shaft that has means for preliminarily breaking up items such as peanuts before they are fed into the main grinding chamber. It has been determined that otherwise, at least some of the nuts tend to ride in a cross-positioned relation on adjacent ridges of the groove portion that is defined thereby. It is thus important to provide a cut-out step or ledge portion 44 in order to avoid any tendency for the auger 40 to jam or become blocked. The ledge 44 has been found to solve this problem in that it assures that all the food items are small enough to rest in the groove portions as such items are fed into the housing 19 of the unit. As shown, the food breaking ledge 44 has a substantially radially positioned planar back face or riser a and a substantially planar front, bottom or entry step face b. The step face b is shown as extending across or cut into one food receiving rib or land of the auger 40 and as forwardly converging towards the direction of rotation into a width substantially corresponding to the width of such rib. The ledge 44 may be termed a breaker step, slot or ledge that extends inwardly to cross a food receiving rib or land portion of the feed auger.

As particularly illustrated in FIGS. 1, 6 and 9, a central open or planar area portion of the operating face or side of each head 27, 35 represents a greater area extent than the total area extent of the projecting, relatively coarse, segment-like, inner, equally spaced-apart sets of teeth 28 and 36 that extend in curved circular lines on the opposed operating faces of the respective heads. The figures also show that finer, rim-like outer teeth 29 and 37 which extend in a curved circular aligned arrangement near the outer periphery of the respective heads have an area extent that is greater than the area extent of peripheral, open-end, out-feed slot, space or groove portions 29a and outwardly closed-end slot, space or groove portions 29b of the rotating head, and the open-end, out-feed slot, space or groove portions of the stationary head 35. It will be noted from FIG. 9 that the slot or space portions 29b are open at their inner ends to the central open spacing area of the associated head 27, but are closed adjacent outer teeth of the finer sets 29. The slots or spaces 29b thus terminate at outer positions at which the food items have been substantially fully ground. As further particularly shown in FIG. 1, the coarse and finer teeth sets of one head are substantially complementary with respect to and, during relative rotative movement between the heads, move in an intermeshing relation with corresponding teeth of the sets of the other head.

I claim:

1. An improved apparatus for grinding food items such as nut kernels into a uniformly textured product which apparatus has a motor-driven shaft, a forwardly extending substantially cylindrical housing, a food advancing auger shaft secured to and extending from the driven shaft along said cylindrical housing for rotative actuation therewithin, a chute positioned above said cylindrical housing and open at its lower end therethrough to deliver food items on said auger shaft for forwardly advancing movement therealong, a front housing secured to and extending forwardly from a front end of said cylindrical housing and defining a radially extending food processing chamber therein, a pair of plate-like grinding heads each having a substantially planar grinding face, the grinding faces of said pair of heads being in an opposed operating position with respect to each other within said processing chamber, one of said pair of heads being mounted to project radially from the front end of said cylindrical housing, means securing the other of said heads in a forwardly positioned relation with respect to said auger shaft for rotative actuation thereby to effect relative rotational movement with respect to said one head, said one head having a centrally located inlet portion to receive food items being forwardly advanced by said auger shaft for introducing them substantially axially centrally into said processing chamber and radially between said opposed grinding faces, each said grinding face having a substantially planar central area portion provided with a group of peripherally widely and substantially equally spaced-apart sets of relatively coarse grinding teeth that extend as circularly curved line segments thereon, each said grinding face also having a rim-like group of finer teeth extending in circularly curved lines therealong adjacent the outer periphery thereof, open-end feed slot portions positioned in a substantially equally peripherally spaced-apart relation to extend outwardly across said group of finer teeth to separate them into relatively closely spaced-apart sets, said slot portions extending in an open-end relation between said planar central area portion to an outer peripheral edge portion of the associated said head for delivering finely ground food material from between said pair of heads into a radial outer portion of said processing chamber, means associated with said other head for thereafter advancing the food material across its outer periphery into a front portion of said processing chamber between said other head and said front housing, and said front housing having an outlet portion for delivering processed food material from the front portion of said chamber.

2. An improved apparatus as defined in claim 1 wherein said outlet portion is of comb-like construction and is positioned in a lower part of said front housing, whereby processed food material is moved outwardly from said chamber in separate streams that combine into a single downflowing stream outside of said front housing.

3. An improved apparatus as defined in claim 1 wherein the sets of coarse and finer teeth of one grinding face are of complementary shape and positioning with respect to and mesh with corresponding coarse and finer teeth of the other grinding face during relative rotative movement of said other head with respect to said one head.

4. In an improved apparatus for grinding food items such as nut kernels into a uniformly textured product which apparatus has a motor-driven shaft, a forwardly extending substantially cylindrical housing, a food advancing auger shaft secured to and extending from the driven shaft in a relatively closed spaced relation along the inside of said cylindrical housing for rotative actuation therein, an inwardly offset step on a food-receiving land portion of said auger shaft for breaking up larger kernels during the advance of said shaft within said cylindrical housing, a chute positioned above said cylindrical housing and open at its lower end therethrough to deliver food items on said shaft for preliminary grinding and advancing movement therealong, a front substantially circular housing secured to and extending forwardly from a front end of said cylindrical housing and defining a radially extending food processing chamber therein, a pair of disc-like grinding heads each having a substantially planar grinding face, the grinding faces of said pair of heads being in an opposed operating position with respect to each other within said processing chamber, one of said heads being mounted to project radially from the front end of said cylindrical housing, means securing the other of said heads in a forwardly positioned relation with respect to said auger shaft for rotative actuation thereby, said one head having a centrally located inlet portion to receive food items from a front end of said auger shaft for introducing them substantially axially centrally into said processing chamber and radially between said opposed grinding faces, each said grinding face having a substantially planar central area portion provided with a group of peripherally widely and substantially equally spaced-apart sets of relatively coarse grinding teeth that extend as circularly curved line segments thereon, each said grinding face also having a rim-like group of finer teeth extending in circularly curved lines therealong adjacent the outer periphery thereof, open-end feed slot portions positioned in a substantially equally peripherally spaced-apart relation to extend outwardly across said group of finer teeth to separate them into relatively closely spaced-apart sets, said slot portions extending in an open-end relation between said planar central area portion and an outer peripheral portion of each said head to deliver finely ground food material from between said pair of heads into a radial outer portion of said processing chamber, and said other head cooperating with said front housing for advancing the food material across the outer periphery of said other head into a forward end of said processing chamber for downward-outward delivery of processed food material from said chamber.

5. In an improved apparatus for grinding food items such as nut kernels into a uniformly textured product which apparatus has a motor-driven shaft, a forwardly extending substantially cylindrical housing, a food advancing auger shaft secured to and extending from the driven shaft along said cylindrical housing for rotative actuation thereby, a chute positioned above said cylindrical housing and open at its lower end therethrough to deliver food items on said auger shaft for forwardly advancing movement therealong, a front housing secured to and extending forwardly from a front end of said cylindrical housing and defining a radially extending food processing chamber therein, a pair of plate-like grinding heads each having a substantially planar grinding face, the grinding faces of said pair of heads being in an opposed operating position with respect to each other within said processing chamber, one of said heads being mounted to project radially from the front end of said cylindrical housing, means securing the other of said heads in a forwardly positioned relation with respect to said auger shaft for rotative actuation thereby, said one head having a centrally located inlet portion to receive food items being forwardly advanced by said auger shaft for introducing them substantially axially centrally into said processing chamber and radially between said opposed grinding faces, each said grinding face having a substantially planar central area portion provided with a group of peripherally widely and substantially equally spaced-apart sets of relatively coarse grinding teeth that extend as circularly curved line segments thereon, each said grinding face also having a rim-like group of finer teeth extending in circularly curved lines therealong adjacent the outer periphery thereof, open-end feed slot portions positioned in a substantially equally peripherally spaced-apart relation to extend outwardly across said group of finer teeth to separate them into relatively closely spaced-apart sets, said slot portions extending in an open-end relation between said planar central area portion to an outer peripheral portion of the associated head for delivering finely ground food material from between said pair of heads into a radially outer portion of said processing chamber, the teeth of said coarser sets of said opposed grinding faces being in a substantially complementary intermeshing operating relation with respect to each other, the teeth of said finer sets of the said opposing grinding faces also being in a substantially complementary intermeshing operating relation with respect to each other, and means associated with said other head for adjusting the intermeshing relation between the said groups of teeth of said opposed grinding faces for controlling the fineness of grinding action effected.

6. An improved apparatus as defined in claim 5 wherein said processing chamber has a bottom outlet portion of comb-like construction to feed the processed food material downwardly therethrough in a plurality of separate streams in such a manner that they combine outside thereof into a single down-flowing stream with respect to said front housing.

7. In an improved apparatus as defined in claim 5 wherein said sets of coarser blades of each of said opposed grinding faces are in a quadrant-positioned spaced-apart relation with respect to each other on their associated grinding faces.

8. An improved apparatus as defined in claim 5 wherein, means is associated with said other head for advancing the food material across the outer periphery thereof into a forward end of said processing chamber, and said front housing has a bottom-positioned outlet for delivering processed food material from the forward end of said processing chamber.

9. An improved apparatus as defined in claim 8 wherein said means comprises wiping blades positioned in a peripherally spaced-apart relation on and about said other head.

10. An improved apparatus as defined in claim 9 wherein, said blades have one portion extending forwardly along the outer periphery of said other head and have an angularly connected front portion extending on a front face of said other head, and said blades are positioned in a substantially equally spaced-apart relation on said other head.

11. An improved apparatus as defined in claim 5 wherein said open end feed slot portions of said pair of heads extend off-radially in the direction of rotation of said other head.

12. An improved apparatus as defined in claim 11 wherein, said other head has a second group of slot portions extending substantially radially in an inner open-end relation from said planar central area portion across a portion of each set of finer teeth thereon, each slot portion of said second group terminates at its outer end inwardly of outermost teeth of said sets of finer teeth, and the slot portions of said second group are of wider extent than and have a substantially equally spaced-apart relation between and with respect to said feed slot portions of said other head.

13. In an improved apparatus for grinding food items such as nut kernels into a uniformly textured product which has a motor-driven shaft, a hollow food advancing auger shaft secured on a forward end of the shaft for rotative actuation thereby, a chute for feeding food items on said auger shaft, a forwardly positioned food processing housing defining a chamber for receiving food items advanced by said auger shaft, a pair of grinding disc-like heads positioned in said chamber, one of said heads being connected to said motor shaft for relative rotation with respect to the other of said heads, complementary relatively coarse widely spaced-apart teeth sets carried as a primary group by inner portions of opposed side faces of each of said heads for coarse-grinding the food items, complementary relatively finer closely spaced-apart teeth sets carried as a secondary group by radial outer portions of opposed side faces of each of said pair of heads, the coarse and finer teeth sets carried by each of the opposed side faces extending circularly thereon, the coarse and finer teeth on the opposed side face of the one head being operatively positioned in a rotatably intermeshing relation with the respective coarse and finer teeth sets on the opposed side face of the other head, means for adjusting the relative axial operating position of said one head with respect to said other head to vary the spacing between the groups of intermeshing teeth, relatively wide spacing portions extending radially between the coarse teeth of the opposed side faces and towards the outer periphery of said heads, and relatively narrow spaced-apart slot portions extending across between the sets of finer teeth of the opposed side faces outwardly from the relatively wide spacing portions to the outer periphery of said heads for feeding food in an outward direction from between the sets of teeth and to an outer peripheral edge of said one head for discharge from said housing.

14. An improved apparatus as defined in claim 13 wherein, the opposed side faces of each of said heads has a space defining planar area between said sets of coarse teeth thereon that is greater than the total area extent defined by said sets, and said planar area of each of said heads extends as slot portions between and along the sets of finer teeth of each of said heads that are of lesser area extent than the total area extent of said sets of finer teeth.

15. An improved machine as defined in claim 13 wherein, said auger shaft is of hollow construction and its back end portion has a fitted-over secured-on positioning with respect to the driven shaft, a spiral spring is positioned within a front end portion of said auger shaft and has a back end in abutment with a front end portion of the driver shaft, said one head has a stub end portion slidably extending into a forward end portion of said auger shaft and into endwise abutment with a front end of said spring, said housing has a threaded adjustment screw operatively positioned therein and extending into operating engagement with said one head for slidably moving its stub end portion inwardly of said auger shaft against tension exerted by said spring for adjusting the operating position of said one head with respect to said other head, and means slidably securing said one head with respect to said auger shaft for rotative actuation thereby as well as for axial adjustment movement with respect thereto.

* * * * *